United States Patent [19]

Schoenberger

[11] 3,939,970

[45] Feb. 24, 1976

[54] MATCH PACKAGES

[76] Inventor: Philip J. Schoenberger, 947 Bellows, West St. Paul, Minn. 55118

[22] Filed: Nov. 27, 1974

[21] Appl. No.: 527,642

[52] U.S. Cl. ..... 206/108; 35/8 R; 206/457

[51] Int. Cl.[2] ..... A24F 27/12

[58] Field of Search ..... 206/104, 106, 108, 109, 206/457, 459; 40/359

[56] References Cited

UNITED STATES PATENTS

| | | | |
|---|---|---|---|
| 1,459,033 | 6/1923 | Pfersch | 206/109 |
| 2,249,168 | 7/1941 | Preno | 206/109 |
| 2,935,185 | 5/1960 | Will | 206/108 |

*Primary Examiner*—William Price
*Assistant Examiner*—Steven E. Lipman

[57] ABSTRACT

A match package is provided which is meant to be child-proof. It has the appearance of an ordinary package of matches, and is preferably even printed on its outer surface to simulate a striking surface. However, the actual striking surface is concealed behind the simulated striking surface, so that unless the person lighting the match is aware of its location, the match will not light.

1 Claim, 6 Drawing Figures

MATCH PACKAGES

This invention relates to an improvement in match packages and deals particularly with the type of match package commonly known as a match book, or book of matches, and which is designed to be child-proof.

BACKGROUND OF THE INVENTION

Many fires have been caused by small children through the use of the book of matches which are readily available in homes where the parents smoke. The fire caused by the igniting of a match has a fascination for children, but often times, the igniting of a match lights the clothing of a child or ignites flamable material which the small children have no way of coping with. As a result, the fires which result can seriously damage garages, houses, and other places in which the fires are started.

The Unites States government has recently started an investigation with the manufacturers of matches in an effort to stop this damage, and the loss of life which is often caused by it. The present invention is designed to prevent small children from lighting matches enclosed in the normal appearing match book to prevent such damage and loss of life.

SUMMARY OF THE INVENTION

The present invention resides in the provision of a match book which has the appearance of a normal match book including a back panel, a top panel, a front panel, and a partial front panel connected to the lower edge of the back panel. The groups of matches are connected in the ordinary way between the partial front panel and the back panel. However, the present invention includes a second partial front panel which overlies the normal partial front panel. In its preferred form, this outer partial front panel is provided with a simulated striking surface which is not capable of igniting the match when the match is rubbed against it. As a result, when the child attempts to light the match against the simulated striking surface, it will not ignite. The actual match striking surface is between the partial front panel and the overlying partial front panel so that the match may be ignited if the match is inserted between the partial front panel and the simulated front partial panel. As a result, while the match will not be ignited by the child, it may be readily ignited by an older person familiar with the construction.

Children who are old enough to understand the arrangement are usually not the ones who start the fires accidentally. In other words, most accidental fires caused by children are also old enough to understand the danger which is involved. The problem is usually caused by children who are very young and who have seen their parents or others use match packages in the usual manner. Such children will usually try to ignite the match on the simulated surface which is exposed, but will not be able to do so. Children who are old enough to realize that the match striking surface is concealed will usually not cause fire which will ignite their clothes or other ignitable material which will cause damage to property.

These and other objects and novel features of the present invention will be more clearly and fully set forth in the following specification and claims.

Figure 4:
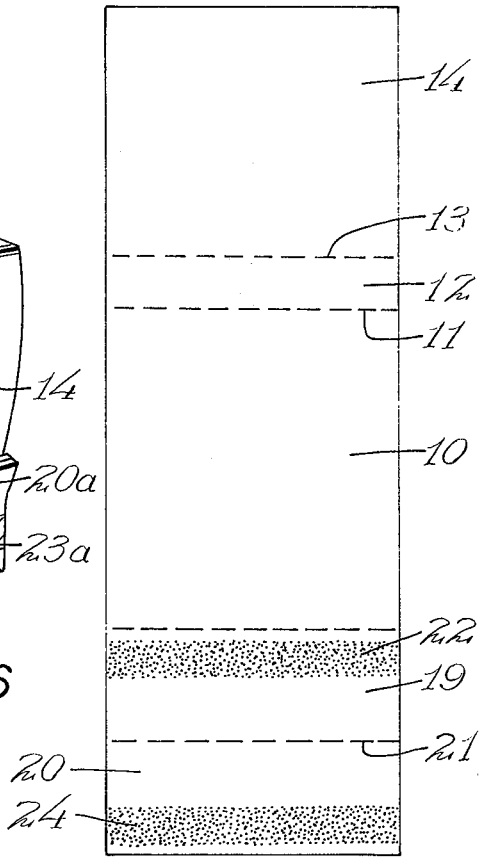
FIG. 4 is a diagrammatic view of the blank from which the match package is formed.

As is indicated in FIG. 4 of the drawings, the match package includes a back panel 10 foldably connected along a fold line 11 to a top panel 12. The top panel 12 is foldably connected along the fold line 13 to the front panel 14. As is indicated, and is common practice, the front panel 14 is somewhat shorter than the back panel 10 because of the fact that the partial front panel encloses the base ends of the match book, and is stapled to the rear panel 10 through the bottom portion of the match book.

As is obvious, the match packages usually contain two layers of matches 15 which are firmly connected at the lower ends 16, and the individual matches such as 17 may be readily broken away from the base portions 16 when the matches are used. The blank indicated in FIG. 4 also includes a first partial front panel 19, and a second partial front panel 20 which is preferably secured to the panel 19 along the fold line 21. In other words, the match package which is illustrated is identical to the normal match package with the exception of the fact that a second partial front panel is added to conceal the usual partial front panel.

Figure 1:
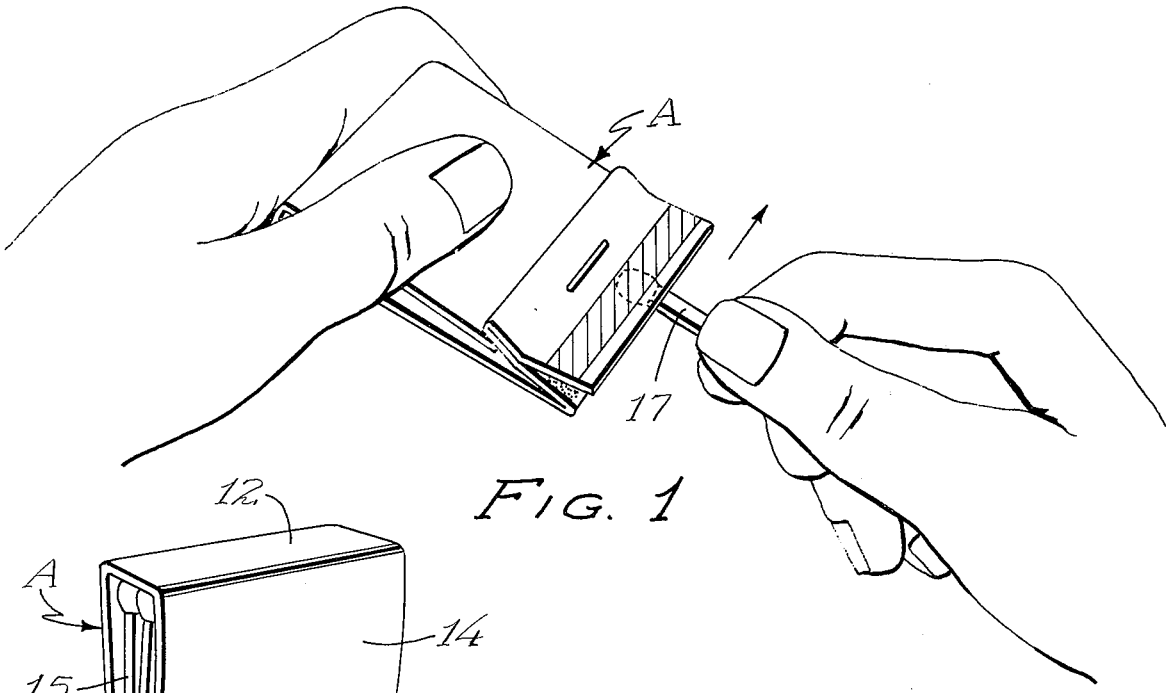
FIG. 1 is a perspective view of the match package showing the manner in which the match is ignited.
Figure 2:
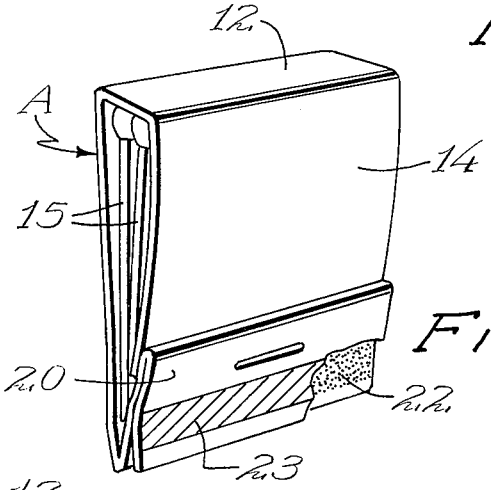
FIG. 2 is a perspective view of the match book in closed position showing the simulated striking surface, a portion of the figure being broken away to show the actual match striking surface.
Figure 3:
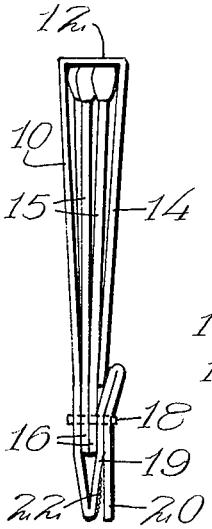
FIG. 3 is a side elevational view of the match package in closed position.

As is indicated in FIG. 3, the base portions 16 of the matches are stapled in the package, the stape 18 extending through the second partial front panel 20, the first partial front panel 19, the bases of the matches 16, and the back panel 10. In other words, the match package which is illustrated is identical to the match packages now in common use with the exception of the fact that the match striking surface 22 is located between the additional partial front panel 20 and the normal front panel 19. An additional striking surface 24 may also be provided on the inner surface of the added panel 20.

To complete the illusion that the match package A is a conventional one, the front panel 20 is preferably provided with a simulated striking surface 23 which is merely printed upon the exposed surface of the extra partial front panel 20. As a result, when the match package falls into the hands of a small child there is a tendency for him to remove the match, and try to ignite it on the surface 23. This is not possible due to the nature of the printed strip 23, and tests have shown that after attempting to ignite a number of the matches from the package, the child will give up and throw the package away with no resulting damage.

Figure 5:
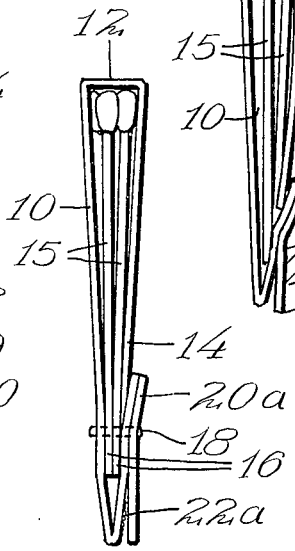
FIG. 5 is a side elevational view of a slightly modified form of construction.
Figure 6:
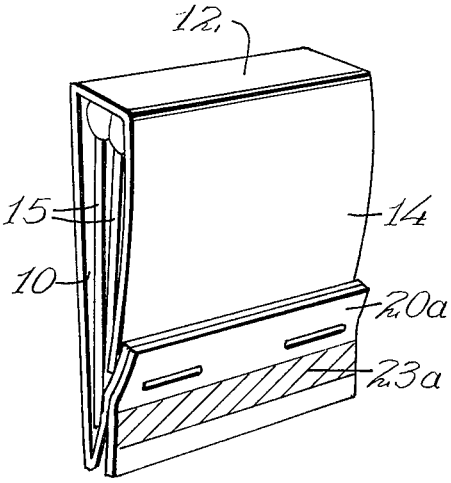
FIG. 6 is a perspective view of the package shown in FIG. 5.

FIGS. 5 and 6 of the drawings show a slightly modified form of construction, and due to the fact the back panel 10, the top panel 12, and the front panel 14 are identical with those which have been described, the same numerals identifying the various parts have been used. The partial front panel 19 is also identical to that previous described. The only difference between the two constructions lies in the fact that the overlying partial front panel 20*a* which includes the simulated striking surface 23*a* is a separate panel. The only reason for showing this arrangement is to indicate that the overlying front panel 20*a* may be a separate piece overlying the panel 19*a a*instead of being foldably secured thereto along the fold line 21. In view of the fact that in all other respects the structures are identical, no further explanation is believed necessary.

In accordance with the Patent Statutes, I have described the principles of construction and operation of our Match Packages, and while I have endeavored to set forth the best embodiments, I desire to have it understood that obvious changes may be made within the scope of the following claims without departing from the spirit of my invention.

I claim:

1. A match package including:

a back panel a top panel foldably connected to said back panel, a front panel foldably connected to said top panel, a partial front panel connected to the lower edge of said back panel, a similar partial front panel overlying said first named front panel, a simulated match striking surface on said similar partial front panel, a group of matches having base portions secured between said partial front panel and said back panel, a match striking surface between said first named front panel and said similar front panel.

* * * * *